US008671849B2

(12) United States Patent
Krieg

(10) Patent No.: US 8,671,849 B2
(45) Date of Patent: Mar. 18, 2014

(54) SHIPPING BASE WITH LOCATOR PINS

(75) Inventor: W. E. Chip Krieg, Saint Joseph, MI (US)

(73) Assignee: Sonoco Development, Inc., Hartsville, SC (US)

( * ) Notice: Subject to any disclaimer, the term of this patent is extended or adjusted under 35 U.S.C. 154(b) by 76 days.

(21) Appl. No.: 12/604,513

(22) Filed: Oct. 23, 2009

(65) Prior Publication Data

US 2011/0095157 A1 Apr. 28, 2011

(51) Int. Cl.
*B65D 19/38* (2006.01)

(52) U.S. Cl.
USPC ..... 108/53.1; 108/55.1; 108/51.11

(58) Field of Classification Search
USPC ..... 248/346.03, 346.01, 188.1, 188.2, 248/188.6, 188.8; 108/55.3, 51.1, 56.1, 108/56.3, 55.5, 54.1, 51.3, 57.3; 206/386, 206/320
See application file for complete search history.

(56) References Cited

U.S. PATENT DOCUMENTS

| | | | | |
|---|---|---|---|---|
| 3,100,594 | A | 8/1963 | Gile | |
| 3,436,045 | A | 4/1969 | Anspaugh | |
| 3,575,288 | A | 4/1971 | Brucken | |
| 3,587,848 | A * | 6/1971 | Froehlig | 206/462 |
| 3,648,959 | A * | 3/1972 | Wagner | 206/320 |
| 3,907,241 | A | 9/1975 | Oglesby et al. | |
| 4,140,295 | A | 2/1979 | Daley | |
| 4,241,892 | A | 12/1980 | Morris | |
| 4,425,852 | A * | 1/1984 | Riviere | 108/56.3 |
| 4,575,034 | A * | 3/1986 | Tobey | 248/188.9 |
| 5,535,668 | A * | 7/1996 | Besaw et al. | 108/51.3 |
| 5,573,212 | A * | 11/1996 | Palazzolo | 248/188.9 |
| 5,799,586 | A * | 9/1998 | Teixidor Casanovas et al. | 108/56.3 |
| 6,026,754 | A * | 2/2000 | Kohlhaas | 108/56.3 |
| 6,584,914 | B1 * | 7/2003 | Koefelda | 108/54.1 |
| 7,258,319 | B2 | 8/2007 | Johanson et al. | |
| 7,325,500 | B2 | 2/2008 | Carpenter et al. | |
| 7,455,017 | B2 | 11/2008 | Carpenter et al. | |

FOREIGN PATENT DOCUMENTS

| | | |
|---|---|---|
| EP | 1701602 B1 | 12/2007 |
| JP | 5-193644 | 8/1993 |

* cited by examiner

*Primary Examiner* — Todd M Epps
(74) *Attorney, Agent, or Firm* — Miller, Matthias & Hull LLP

(57) ABSTRACT

A shipping base for use with an appliance or other large product is provided. The base includes locator pins for removably securing the base to the appliance via a friction fit. The locator pins are captured by and extend upwardly from a folded corrugated member to frictionally engage the appliance. The locator pins preferably have a conical upper portion to help guide the pins into footholes or other openings in the bottom of the appliance.

7 Claims, 4 Drawing Sheets

SHIPPING BASE WITH LOCATOR PINS

BACKGROUND

1. Field of the Invention

This invention relates to a shipping base or pallet for an appliance. More particularly, this invention relates to a shipping base that includes plastic locator pins that help position the appliance on the base and hold the base to the appliance via friction fit.

2. Description of the Related Art

Large household appliances such as washers and dryers typically are assembled while resting on pads or bases. The base fits under the appliance and may have openings at the corners to accommodate the appliance feet.

Today appliances are more commonly assembled and shipped without the feet attached. The appliances are still assembled while resting on a base, and the base is sometimes secured to the appliance with bolts.

A problem with using bolts to secure a base to an appliance is that it requires threading (rotating) the bolts to both secure and remove the base. The present invention solves this problem by providing a base that can be quickly and easily secured to an appliance with a friction fit.

Thus it is an object of the present invention to provide an appliance shipping base that can be easily attached to and disengaged from an appliance.

Further and additional objects will appear from the description, accompanying drawings, and appended claims.

SUMMARY OF THE INVENTION

The present invention is a shipping base for use with an appliance or other large product, the shipping base including means for removably securing the base to the appliance via a friction fit. The base comprises a folded corrugated member, foam members and locator pins. The foam members are affixed to the upper surface of the folded member and function as the load bearing surfaces. In a key aspect of the invention, the locator pins are captured by and extend upwardly from the folded corrugated member to frictionally engage the bottom of the appliance. The locator pins preferably have a conical upper portion to help guide the pins into footholes or other openings in the bottom of the appliance.

The shipping base may be secured to the appliance while it is on an assembly line by positioning the appliance over the base and lowering (such as by tilting) the appliance so that the locator pins become inserted into the appliance footholes. At the end of the assembly line a carton may be placed over the appliance and shipping base before shipping. The base remains with the appliance during shipping and can be removed when the appliance is delivered to the buyer's home and the appliance feet can then be installed.

DETAILED DESCRIPTION OF THE INVENTION

Figure 1:
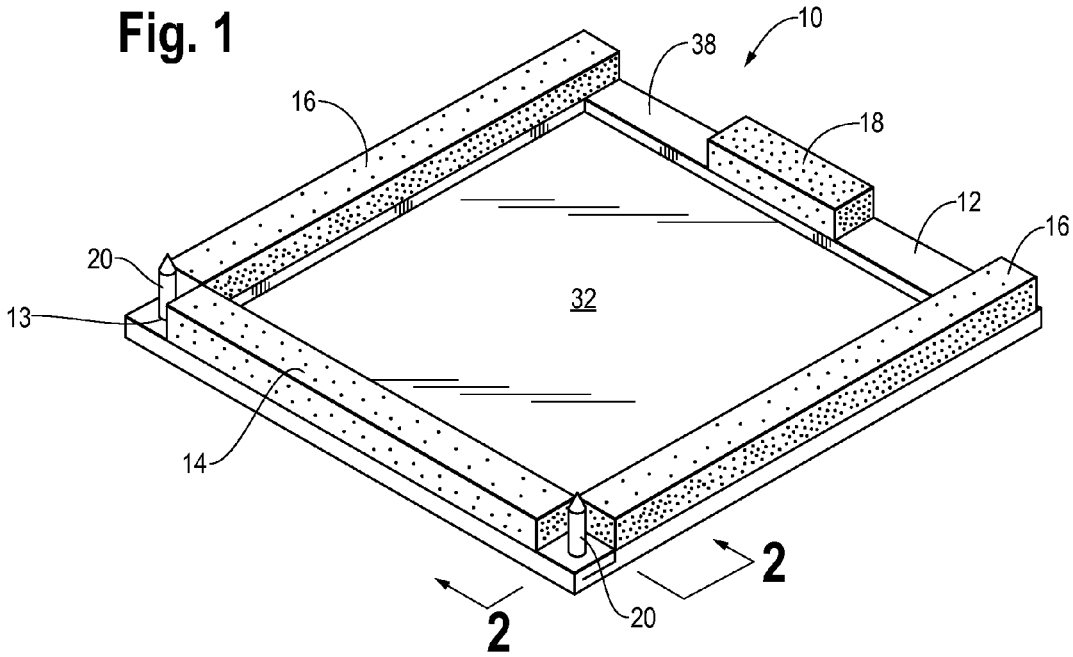
FIG. 1 is a perspective view of a shipping base according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The Shipping Base

Turning to the drawings, there is shown in FIG. 1 one embodiment of the present invention, a shipping base for use with an appliance or other large product, the shipping base including means for removably securing the base to the appliance via a friction fit. The base 10 comprises a folded corrugated member 12 and foam members 14, 16 and 18 affixed to upper surfaces of the folded member 12. In a key aspect of the invention, the base 10 further comprises a pair of locator pins 20 captured by and extending upwardly from the folded corrugated member 12 to frictionally engage the appliance 50.

Locator Pins

Figure 2:
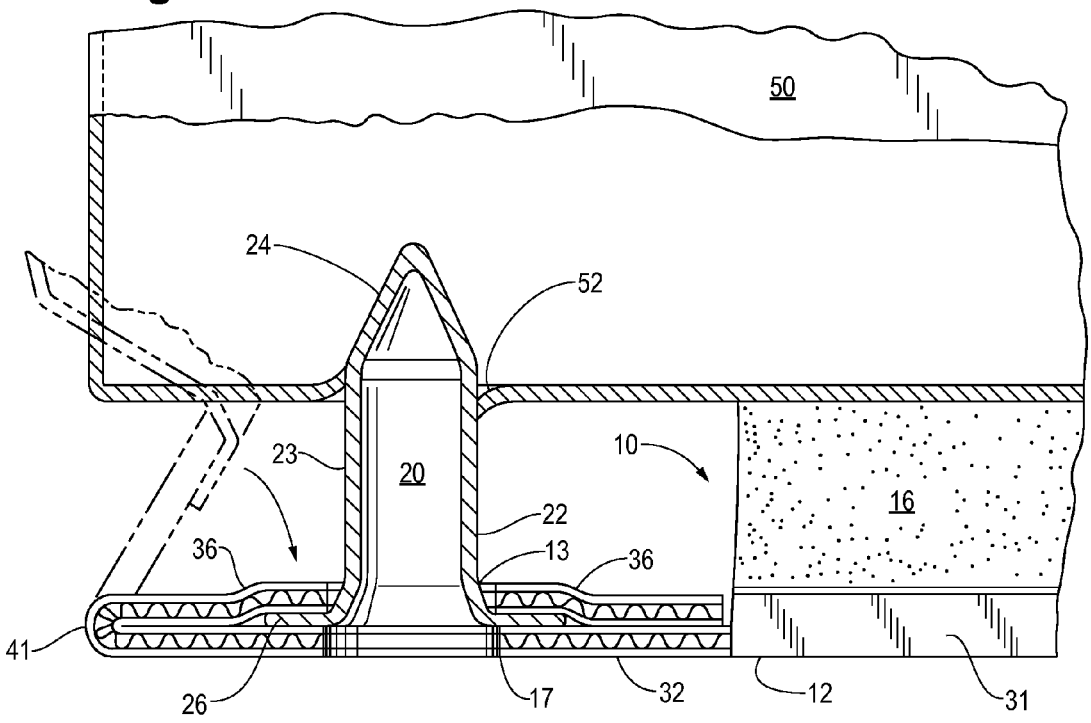
FIG. 2 is a cross-sectional view of the shipping base of FIG. 1 taken along line 2-2.
Figure 7:
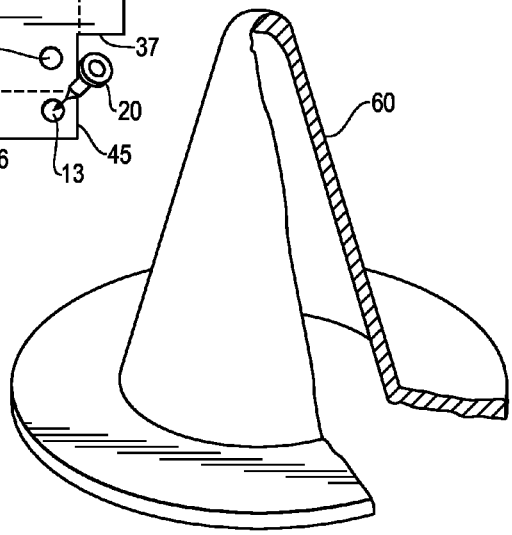
FIG. 7 is a perspective view of an alternative embodiment of the locator pins that form part of the shipping base of FIG. 1.

As best shown in FIG. 2, each locator pin 20 comprises a hollow body 22 and a flange 26 located at the base of the body 22 and extending outwardly from the body 22. In the preferred embodiment the body 22 comprises a substantially conical upper portion 24 and a substantially cylindrical lower portion 23, with the flange 26 extending from the bottom of the lower portion 23. Other locator pin shapes are contemplated, including a pin 60 having a completely conical body as shown in FIG. 7. The locator pins 20 may be made of any suitable resilient material, such as but not limited to high density polyethylene plastic (HDPE).

Folded Member

Figure 5:
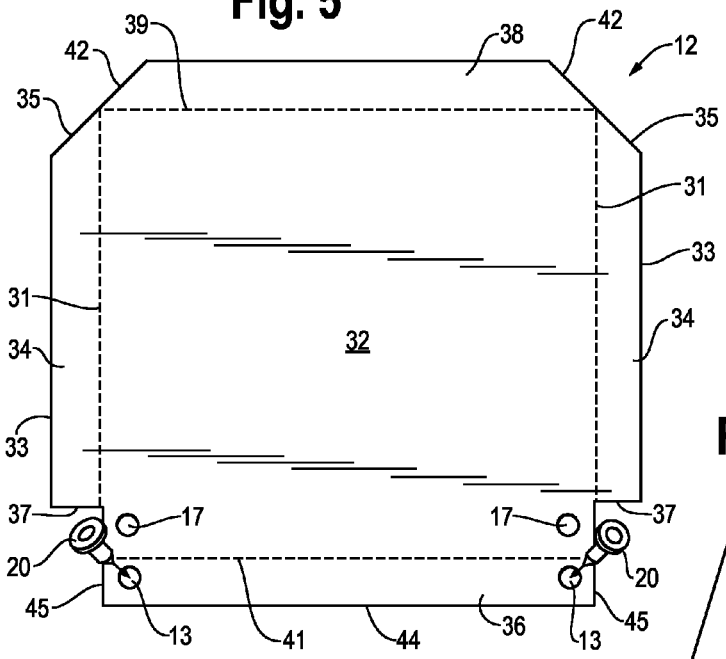
FIG. 5 is a top view of a corrugated blank used to form part of the shipping base of FIG. 1, shown with locator pins about to be inserted into openings in the base.

FIG. 5 shows the folded member 12 prior to being folded and the locator pins prior to being inserted into pin openings 13 in the folded member 12. As shown in the figure, the folded member 12 comprises a rectangular central panel 32, opposing side flaps 34, a rear flap 38 and a front flap 36 having a pair of pin openings 13 located near either end of the flap 36. The pin openings 13 are substantially circular and have a diameter less than the diameter of the locator pin flanges 26. The rectangular central panel 32 extends between two opposing side fold lines 31 and opposing front and rear fold lines 41, 39.

Each opposing side flap 34 is shaped like a right trapezoid, i.e, a trapezoid having two right angles at one end of the side flap 34 and complementary acute and obtuse angles at the opposite end. Each side flap 34 is attached to the central panel 32 along a side fold line 31. Each side flap 34 comprises a distal edge 33 opposite and substantially parallel to the side fold line 31, a first side edge 35 extending diagonally from the side fold line 31 to the distal edge 33, and a second side edge 37 extending perpendicularly from the fold line 31 to the distal edge 33. The first side edge 35 and the fold line 31 form an acute included angle.

The rear flap 38 is trapezoidal shaped and is attached to the central panel 32 along the rear fold line 39 and comprises a distal edge 43 opposite and substantially parallel to the rear fold line 39 and first and second side edges 42 extending diagonally from the rear fold line 39 to the distal edge 43. Each side edge 42 and the fold line 39 form an acute included angle.

The front flap 36 is rectangular and is attached to the central panel 32 along the front fold line 41 and comprises a distal edge 44 opposite and substantially parallel to the front fold line 41 and first and second side edges 45 extending perpendicularly from the front fold line 41 to the distal edge 44. The pin openings 13 located at opposite ends of the front flap 36 are configured to receive the locator pins 20.

Figure 6:
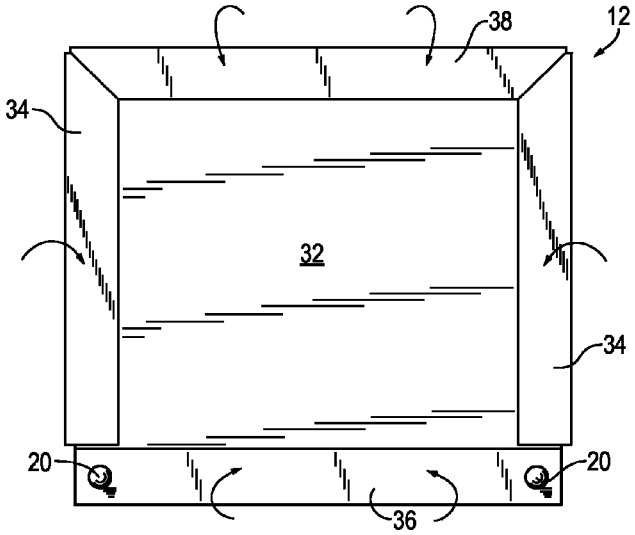
FIG. 6 is a top view of the corrugated blank and locator pins of FIG. 5 shown after they have been assembled.

Preferably, the side flaps 34, front flap 36 and rear flap 38 are shaped in complementary fashion so that, when the flaps are folded over as shown in FIG. 6, the flap edges mate to form a substantially continuous double layered "frame" on which the load bearing foam members 14, 16, 18 can be attached.

Stacking holes 17 are cut into the central panel 32 to allow the bases 10 to be stacked as explained below. The stacking holes 17 are located opposite the pin openings 13 and equidistant from the front fold line 41 so that the stacking holes 17 and pin openings 13 are in vertical alignment after the base 10 is assembled.

Folded Member Alternative Embodiments

Figure 8:
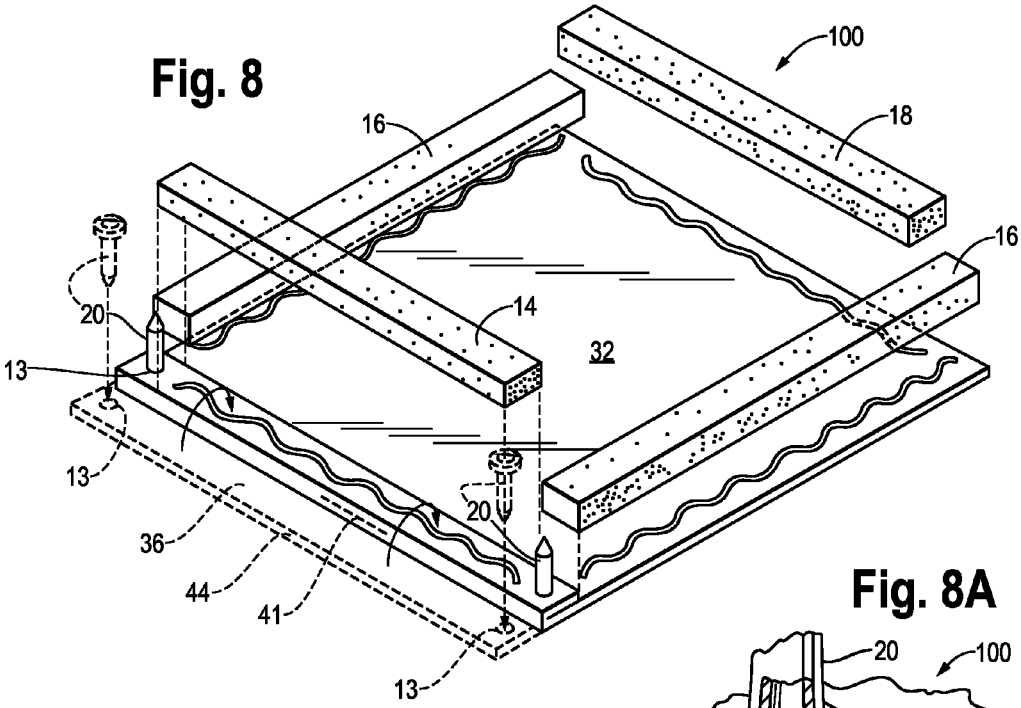
FIG. 8 is an exploded view of an alternative embodiment of the shipping base of the present invention.
Figure 9:
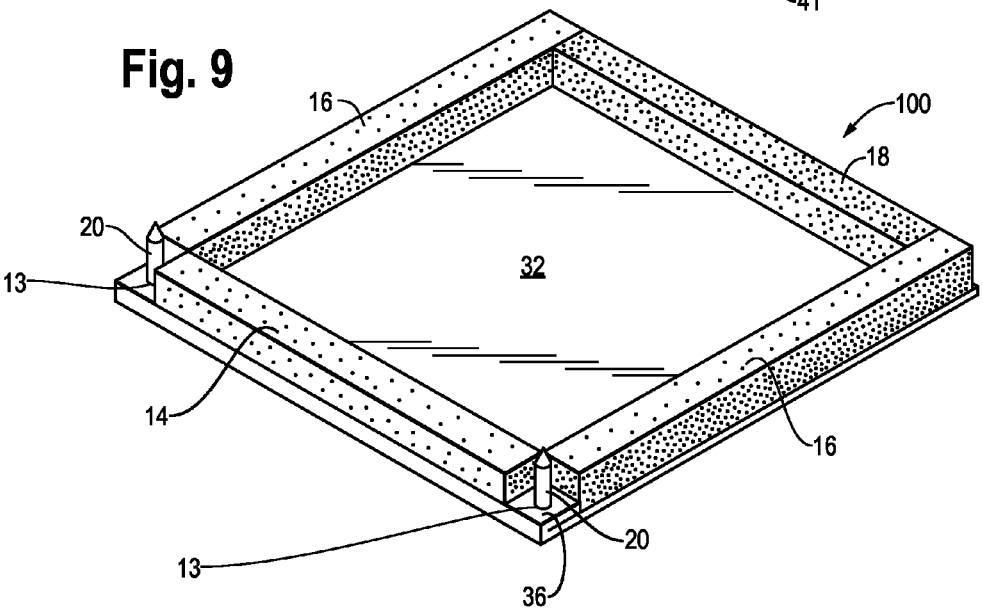
FIG. 9 is a perspective view of the shipping base of FIG. 8 shown fully assembled.

The frame to which the load bearing foam members 14, 16, 18 are attached can be double layered (i.e., comprising two layers of corrugated) along all four edges as described above and shown in FIGS. 1-6, or single layered along one, two or three edges (from among the side and rear edges) and double layered only along the front edge. For example, in the alternative embodiment shown in FIGS. 8-9, the folded member is double layered only along the front edge. The folded member lacks the side flaps 34 and/or the rear flap 38 of the folded member 12 of FIGS. 1-6. The front edge of the folded member still comprises a front flap 36 that can be folded over onto the central panel 32, and thus remains "double layered", while the side and/or rear edges of the folded member are single layered. As best shown in FIG. 8, the side and rear foam members 16, 18 are affixed directly to the central panel 32.

Figure 8A:
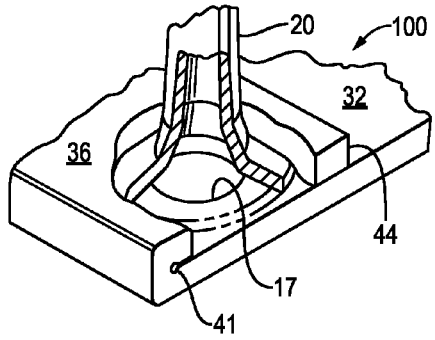
FIG. 8A is a close up perspective view of a portion of the shipping base of FIG. 8, with a cutaway view of one of the locator pins.

In every embodiment of the invention, the flange portion 26 of each locator pin 20 is captured between top and bottom corrugated layers, the top corrugated layer being the front flap 36 and the bottom corrugated layer being the central panel 32 (as shown in FIGS. 2 and 8A).

It should be understood that, while the folded member 12 is described as being made from corrugated, it may be made from any suitable material, including but not limited to multilayered paperboard, honeycomb and plastic. Likewise, the foam members 14, 16, 18 may be made from any suitable material that provides cushioning, including foam material and non-foam material.

Assembly

To assemble the base 10, the locator pins 20 are inserted through the pin openings 13 in the front flap 36 and the front flap 36 is folded over on top of the central panel 32 and glued to the central panel 32 so that the front flap 36 and central panel 32 are in facing abutment with each other as shown in FIGS. 2 and 6. In this position the bottom side of the front flap 36 is now facing up and the tapered tips (upper portion) 24 of the pins 20 extend upward. This assembly step captures the flange portion 26 of each locator pin 20 between the central panel 32 and the front flap 36 as best shown in FIG. 2. The other flaps 34, 38 are also folded over and glued to the central panel 32, creating a base 10 having a four-sided "frame" comprising a double thickness of corrugated along each edge of the base 10.

Figure 3:
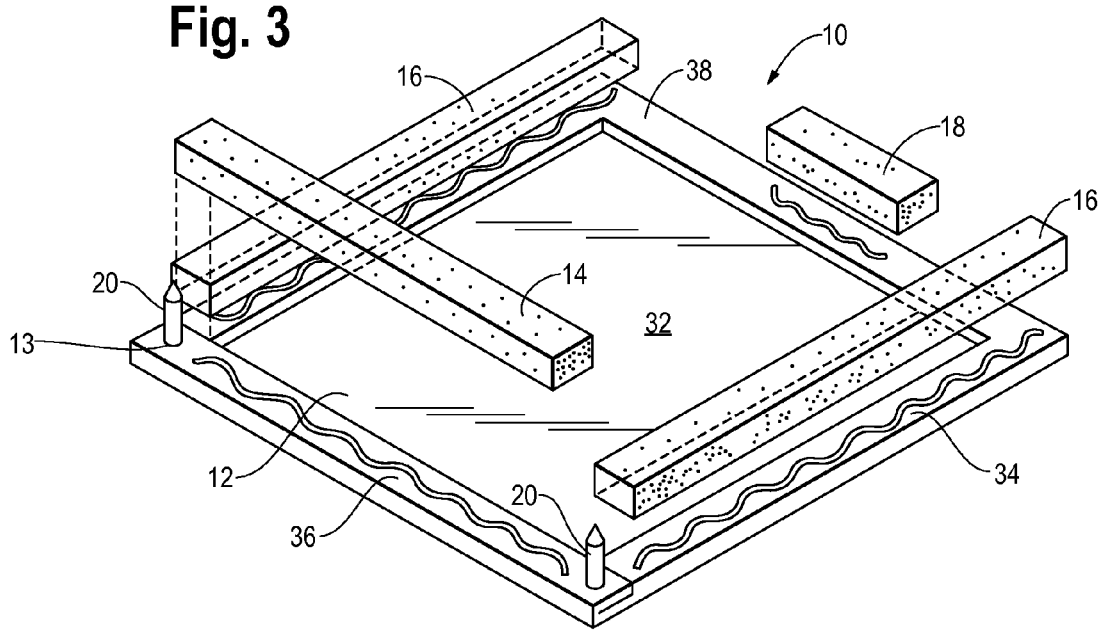
FIG. 3 is an exploded view of the shipping base of FIG. 1.

Referring to FIG. 3, the foam members 14, 16 and 18 are then glued in place along the base edges to function as the load bearing surfaces of the base 10. Specifically, front foam member 14 is glued to front flap 36; side foam members 16 are glued to side flaps 34; and rear foam member 18 is glued to rear flap 38.

Positioning the Appliance

Referring again to FIG. 2, the pallet 10 may be secured to an appliance 50 while the appliance 50 is on an assembly line by positioning the appliance 50 over the pallet 10 and lowering (such as by tilting) the appliance 50 so that the locator pins 20 become inserted into the footholes 52 of the appliance 50. The conical upper portions 28 of the locator pins 20 help locate the pins 20 within the footholes 52. The locator pins 20 form a friction fit with the appliance footholes 52 to keep the pallet 10 firmly secured to the appliance 50.

At the end of the appliance assembly line a carton (not shown) may be placed over the appliance and base assembly before shipping. The base 10 remains with the appliance 50 and can be removed when the appliance 50 is delivered to its ultimate location, typically a buyer's home, and the appliance feet (not shown) can then be installed.

Stacking

Figure 4:
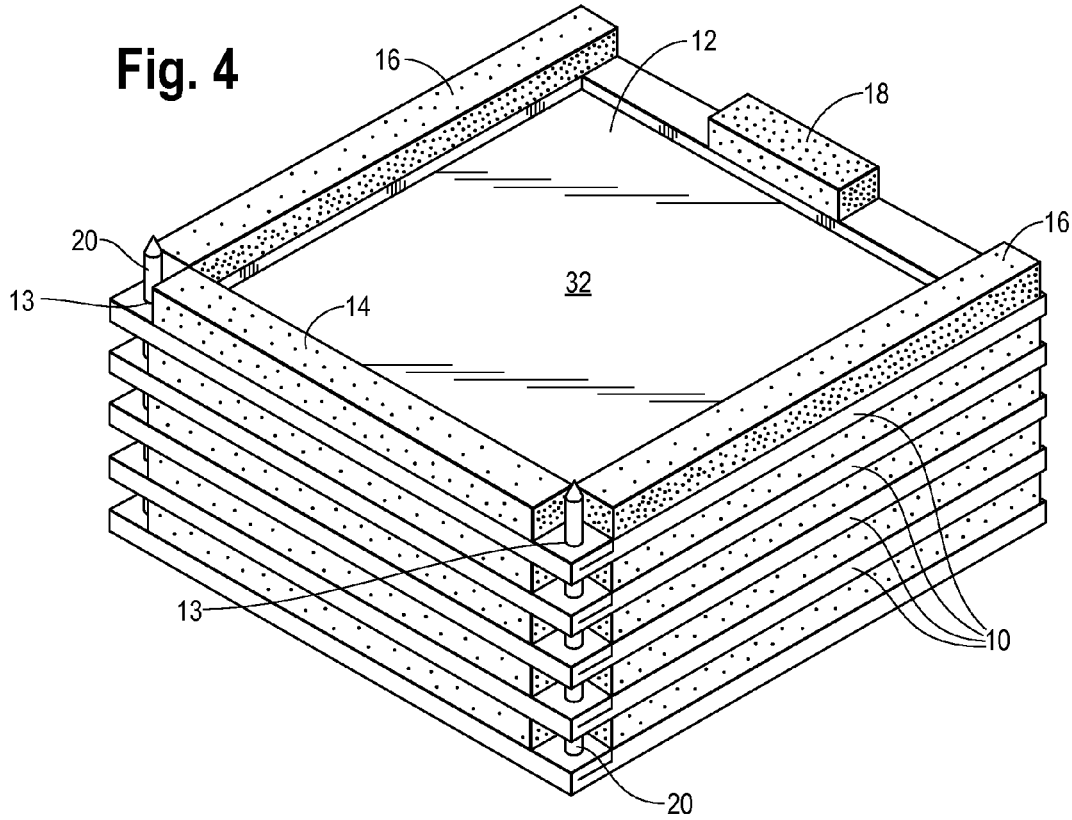
FIG. 4 is a perspective view of a stack of shipping bases according to the present invention.

As shown in FIG. 4 multiple shipping bases 10 can be stacked on top of one another, with the locator pins 20 of one base 10 extending through the stacking holes 17 and into the hollow centers of the locator pins 20 of the base 10 above to stabilize the stack and reduce the amount of space needed.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A shipping base for a large household appliance, the shipping base comprising:

a folded member, the folded member comprising a substantially rectangular central panel, opposing side flaps attached to the central panel along side fold lines, a rear flap attached to the central panel along a rear fold line and an elongated front flap attached to the central panel along a front fold line, the side flaps, rear flap and front flap folded over on top of the central panel so that the flaps and the central panel are in facing abutment with each other, the front flap having opposing ends and a pin opening located near each opposing end, each pin opening having a diameter;

a pair of locator pins, each locator pin comprising a body and a flange extending laterally outward from the body, the body having a smooth conical upper portion and a smooth cylindrical lower portion configured to easily receive a foothole of an appliance to removably secure the appliance to the shipping base with a friction fit, the flange having a top side and a bottom side and a diameter greater than the diameter of the pin opening, each locator pin extending upwardly through one of the pin openings with its flange captured between the central panel and the front flap, wherein the central panel abuts the bottom side of the flange and the front flap abuts the top side of the flange to hold and support the flange in a stationary, fixed relationship with respect to the folded member without any type of fasteners; and foam members affixed to the front flap, side flaps and rear flap;

wherein the foam members define a planar load bearing surface and the locator pins extend above the load bearing surface.

2. The shipping base of claim 1 wherein the central panel defines stacking holes located opposite the pin openings and equidistant from the front fold line, and wherein the stacking holes and pin openings are in vertical alignment.

3. The shipping base of claim 2 wherein the folded member is made from corrugated and the locator pins are formed from plastic.

4. The shipping base of claim 1 wherein the locator pins have hollow centers and wherein the central panel defines stacking holes vertically aligned with the pin openings so that multiple shipping bases can be stacked on top of one another with the locator pins of one shipping base extending through the stacking holes and into the hollow centers of the locator pins of the shipping base above.

5. The shipping base of claim 1 wherein the central panel defines stacking holes located opposite the pin openings and equidistant from the front fold line, and wherein the stacking holes and pin openings are in vertical alignment.

6. The shipping base of claim 5 wherein:

each locator pin has a bottom surface defining a bottom opening and a hollow center communicating with the opening, the hollow center configured to receive the locator pin of another similarly configured shipping base for stacking purposes, and wherein the stacking holes in the central panel are at least as large as the bottom openings.

7. A shipping base for a large household appliance, the shipping base comprising:

a folded member, the folded member comprising a substantially rectangular central panel, opposing side flaps attached to the central panel along side fold lines, a rear flap attached to the central panel along a rear fold line and an elongated front flap attached to the central panel along a front fold line, the side flaps, rear flap and front flap folded over on top of the central panel so that the flaps and the central panel are in facing abutment with each other, the front flap having opposing ends and a pin opening located near each opposing end, each pin opening having a diameter;

a pair of locator pins, each locator pin comprising a body and a flange extending laterally outward from the body, the body configured to easily receive a foothole of an appliance to removably secure the appliance to the shipping base with a friction fit, the flange having a top side and a bottom side and a diameter greater than the diameter of the pin opening, each locator pin extending upwardly through one of the pin openings with its flange captured between the central panel and the front flap, wherein the central panel abuts the bottom side of the flange and the front flap abuts the top side of the flange to hold and support the flange in a stationary, fixed relationship with respect to the folded member without any type of fasteners; and foam members affixed to the front flap, side flaps and rear flap;

wherein the foam members define a planar load bearing surface and the locator pins extend above the load bearing surface;

wherein each locator pin body is substantially conical.

* * * * *